United States Patent [19]

Cresswell

[11] Patent Number: 4,652,887

[45] Date of Patent: Mar. 24, 1987

[54] ANTENNA DRIVE

[75] Inventor: Richard Cresswell, Colchester, England

[73] Assignee: The General Electric Company p.l.c., London, England

[21] Appl. No.: 680,950

[22] Filed: Dec. 11, 1984

[30] Foreign Application Priority Data

Dec. 16, 1983 [GB] United Kingdom ..... 8333547
Aug. 3, 1984 [GB] United Kingdom ..... 8419901

[51] Int. Cl.[4] ..... H01Q 3/04
[52] U.S. Cl. ..... 343/766
[58] Field of Search ..... 343/765, 766, 757, 761, 343/763, 882

[56] References Cited

U.S. PATENT DOCUMENTS 4,118,705 10/1978 Varley ..... 343/766

*Primary Examiner*—Eli Lieberman
*Attorney, Agent, or Firm*—Spencer & Frank

[57] ABSTRACT

An antenna is pivoted on a mounting about a first axis (3) and is driven by a screw threaded drive member (5) to which it is pivoted about a second axis (4). The drive member (5) engages a drive mechanism (6) which is pivoted about a third axis (7) all the axes being parallel. At one position of adjustment (illustrated) the second and third axes (4,7) are in line with each other enabling the drive member (5) to be pivoted to the position shown in broken lines thereby doubling the size of the arc through which the antenna can be rotated.

4 Claims, 5 Drawing Figures

ANTENNA DRIVE

BACKGROUND OF THE INVENTION

This invention relates to an antenna drive. In one conventional type of antenna drive system the antenna is caused to scan repetitively through an arc of 80 or 90 degrees by a longitudinal screw threaded drive member which is moved to and fro by an electrically operated drive mechanism engaging with the screw thread. In such systems the screw threaded drive member is pivoted to the antenna structure and the drive is pivoted to a fixed mounting structure so as to accommodate relative turning movements between those parts during operation of the drive member. It is sometimes desired to adjust the mounting of the antenna so that it scans through a different arc. Hitherto, in order to effect such adjustment it has been necessary to unbolt the antenna drive from its mounting and rebolt it at an alterhative position. This is obviously a very time consuming exercise and it is of course impracticable to make such adjustment whilst tracking a target which may move from one of the said arcs to the other. It was with this problem in mind that the present invention arose.

SUMMARY OF THE INVENTION

The invention provides an antenna drive system comprising an antenna structure pivoted on a mounting about a first axis, a longitudinal drive member pivoted to the antenna structure about a second axis, and a drive mechanism pivoted to the mounting about a third axis and arranged to drive the drive member longitudinally so as to cause rotation of the antenna structure through an arc; the second and third axes being arranged to be co-linear at one point of movement of the drive member, enabling the drive member and drive mechanism to be pivoted to an opposite side of a plane containing the first and second axes. By pivoting the drive member and drive mechanism in this way the antenna can be made to scan, at the choice of the operator, through one or other of two possible arcs. Alternatively, if some automatic mechanism is provided to pivot the drive mechanism and drive member each time the position is reached when such pivoting can take place, the antenna can be made to scan through twice the arc which would otherwise be possible.

The invention is also applicable to a tracking system in which the antenna is driven in a direction so as to follow the movement of a target. In such a tracking system it is sometimes required that the antenna should oscillate or rotate about a mean direction which is known to be the approximate direction of the target. This enables the system to steer the antenna so that its mean direction follows movement of the target. In such a system, in order that the antenna should be able to oscillate or rotate about that direction which it adopts when the second and third axes are co-linear, the designs preferably allow the second axis to be driven through and slightly beyond the point where it is co-linear with the third axis during movement of the antenna through each arc.

It is envisaged that the invention will find greatest application for effecting scanning movement in azimuth but it will be appreciated that the invention could equally well be adapted to cause scanning in elevation.

BRIEF DESCRIPTION OF THE DRAWINGS

One way in which the invention may be performed will now be described by way of example with reference to the accompanying drawings in which.

DESCRIPTION OF THE PREFERRED EMBODIMENTS

Referring to FIGS. 1, 2, 3 and 4 of the drawings, an antenna structure indicated generally by reference 1 includes a radius arm 2 which carries an antenna 2A and is pivoted about a first vertical axis 3 to a fixed mounting structure 10.

Figure 1:
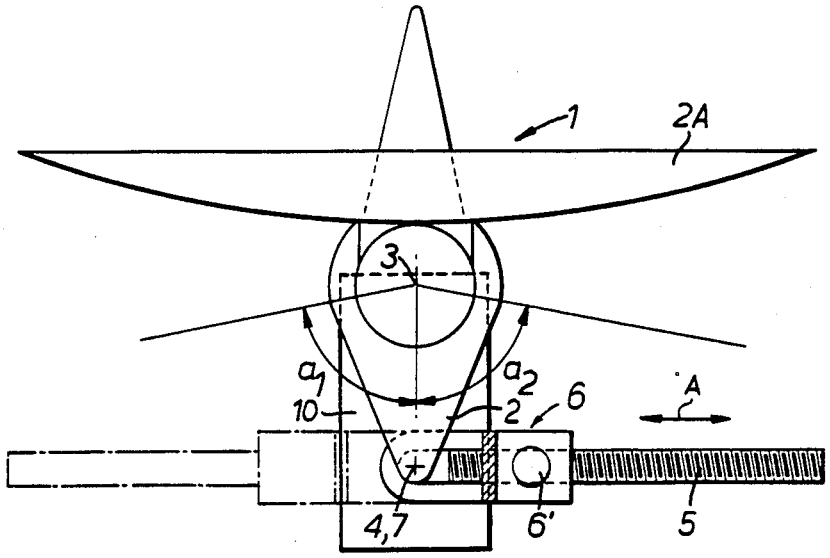
FIG. 1 shows a plan view of apparatus constructed in accordance with the invention in the position where pivoting of the drive member and drive mechanism can take place.
Figure 3:
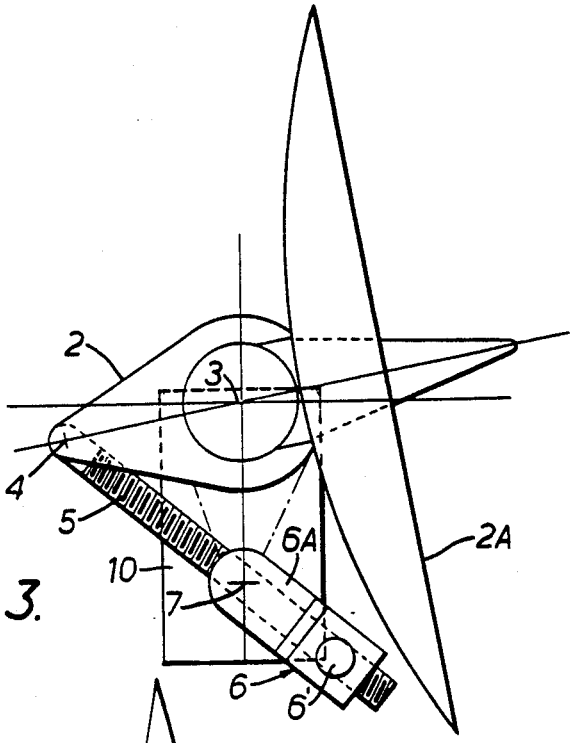
FIGS. 3 and 4 show plan views of the apparatus of FIGS. 1 and 2 in extreme positions of pivoting movement to the right and left respectively.
Figure 4:
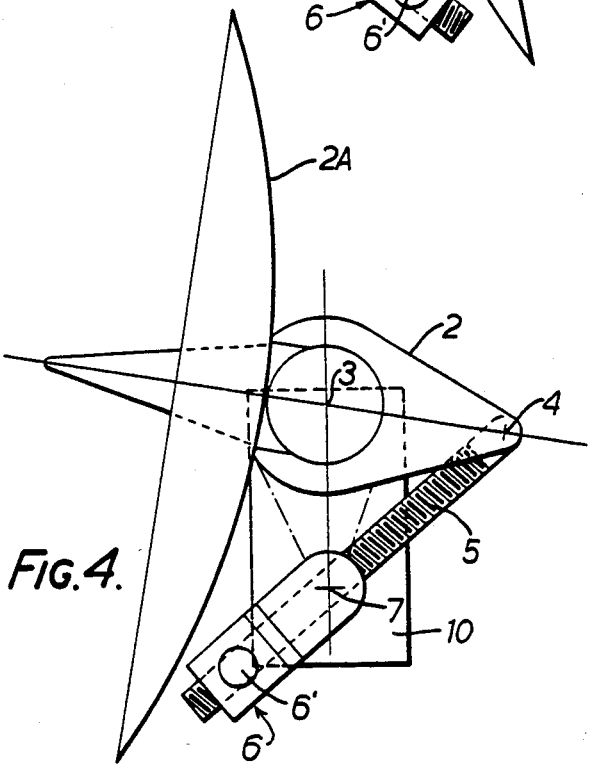

The radius arm 2 is pivoted about a second vertical axis 4 to one end of a drive member in the form of a screw threaded shaft 5 which is driven longitudinally by an electrically operated drive mechanism. The drive mechanism 6, which works along conventional principles, is seen best in FIG. 3 and is unconventional in that it has two arms 6A (only one of which is shown in FIGS. 1, 3 and 4) which extend towards the second axis 4 and by which the drive mechanism is pivoted, about a third axis 7, to the fixed mounting structure 10. The drive mechanism 6 includes a motor 6' which, for example, may rotate an internally threaded gear or sleeve (not shown) which is threadedly coupled to the threaded shaft 5 to extend or retract the same in the direction indicated by the double-headed arrow A.

When the parts 5, 6 and 7 are in the position shown in full lines on FIG. 1, operation of the drive mechanism 6 will drive the antenna through the arc indicated as $a_1$ to the position shown in FIG. 3. Alternatively, starting from the position illustrated in FIGS. 1 and 2, where it is to be noted that the axes 4 and 7 are in line with each other, the parts 5 and 6 can be pivoted through 180° to the position as shown in broken lines in FIG. 1. Such pivoting taking place through the imaginary plane containing an axes 3 and 7. After making this adjustment, operation of the drive mechanism 6 will cause the antenna structure to pivot through the arc $a_2$ to the position shown in FIG. 4. Thus a total arc of $a_1+a_2$ can be covered without a major close down of the installation or antenna drive.

Figure 2:
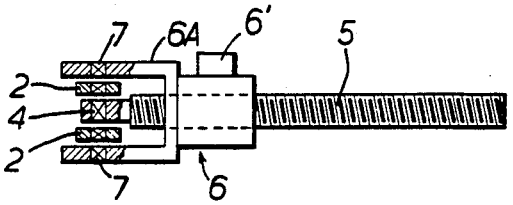
FIG. 2 shows an elevational view of part of the apparatus shown in FIG. 1.
Figure 2A:
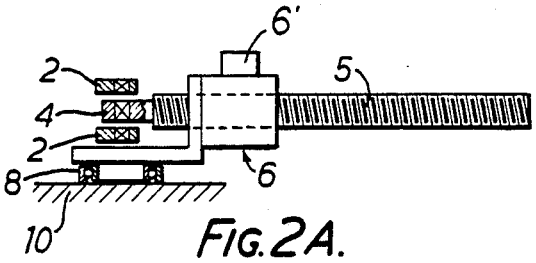
FIG. 2A shows an elevational view of an alternative construction to that shown in FIG. 2.

Should it prove difficult in a particular application to arrange for the pivot for the drive assembly as shown in FIG. 2 an alternative arrangement can be adopted as is shown in FIG. 2A where the drive assembly is mounted on a turntable arrangement 8.

I claim:

1. An antenna drive system comprising an antenna structure pivoted on a mounting about a first axis, a longitudinal drive member pivoted to the antenna structure about a second axis, and a drive mechanism pivoted to the mounting about a third axis and arranged to drive the drive member longitudinally so as to cause rotation of the antenna structure through an arc; the second and third axes being arranged to be co-linear at one point of movement of the drive member, enabling the drive member and drive mechanism to be pivoted to an opposite side of a plane containing the first and second axes.

2. An antenna drive system according to claim 1, wherein said drive mechanism includes two arms which extend towards the second axis and which allow said drive mechanism to be pivoted about the third axis.

3. An antenna drive system comprising an antenna structure including an antenna and a radius arm affixed thereto, said radius arm having a first pivot point for rotation about a first axis with respect to a fixed mounting structure, said arm further having a second pivot point for rotation about a second axis;

a drive member, having a longitudinal axis, pivotably connected to said radius arm for rotation about said second axis;

a drive mechanism coupled to said drive member for driving said member along said longitudinal axis, said drive mechanism having a pair of spaced arms extending in a direction parallel to said longitudinal axis and being rotatable with respect to said mounting structure about a third axis, said drive member and mechanism being rotatable, when said second and third axes coincide, from a first position to a second position displaced from said first position by 180° in a plane defined by said first and third axes, operation of said drive mechanism from said first and second positions angularly displacing said antenna through first and second arcs respectively, thereby permitting total displacement of said antenna through an angle equal to the sum of said first and second arcs.

4. An antenna drive system comprising an antenna pivoted about a first axis;

a radius arm which supports said antenna and which is pivoted about a second axis;

a screw threaded shaft having one end thereof pivoted to said radius arm about said second axis; and a drive mechanism engaged with said screw threaded shaft and operable for driving said antenna via movement of said shaft, said drive mechanism having two arms which extend towards said second axis, and said drive mechanism being pivoted to said radius arm along a third axis;

the second and third axes being co-linear at one point of movement of said shaft thereby allowing said shaft and said drive mechanism to be pivoted 180° through a plane containing the first and third axes.

* * * * *